US008713834B2

(12) United States Patent
Daniel et al.

(10) Patent No.: US 8,713,834 B2
(45) Date of Patent: May 6, 2014

(54) REINFORCEMENT CLIP FOR USE WITH A FIREARM MAGAZINE

(75) Inventors: Buddie Daniel, Kennesaw, GA (US); William Barrett, Kennesaw, GA (US); Robert Howard, Kennesaw, GA (US); J. Keith Coleman, Kennesaw, GA (US); Kenneth Scott Phillips, Dallas, GA (US)

(73) Assignee: RA Brands, L.L.C., Madison, NC (US)

( * ) Notice: Subject to any disclaimer, the term of this patent is extended or adjusted under 35 U.S.C. 154(b) by 358 days.

(21) Appl. No.: 13/048,524

(22) Filed: Mar. 15, 2011

(65) Prior Publication Data

US 2012/0233899 A1 Sep. 20, 2012

(51) Int. Cl.
*F41A 9/61* (2006.01)

(52) U.S. Cl.
USPC ..... 42/49.01; 42/50; 42/106

(58) Field of Classification Search
USPC ..... 42/49.01, 49.02, 52, 49.1, 106
See application file for complete search history.

(56) References Cited

U.S. PATENT DOCUMENTS

| | | | | |
|---|---|---|---|---|
| 5,950,283 | A * | 9/1999 | Sato | 24/67 R |
| 8,028,455 | B1 * | 10/2011 | Battaglia | 42/49.02 |
| 2012/0227300 | A1 * | 9/2012 | Seeley et al. | 42/49.02 |

* cited by examiner

*Primary Examiner* — Daniel J Troy
(74) *Attorney, Agent, or Firm* — Womble Carlyle Sandridge & Rice, LLP

(57) ABSTRACT

A reinforcement device for reinforcing a locating pin aperture in a firearm magazine. The reinforcement device includes a front panel with an aperture adapted to be coaxially aligned with the locating pin aperture. The reinforcement device also includes a clamp adapted to secure the front panel to the firearm magazine to ensure accurate alignment of the front panel aperture with the locating pin aperture.

9 Claims, 9 Drawing Sheets

REINFORCEMENT CLIP FOR USE WITH A FIREARM MAGAZINE

TECHNICAL FIELD

The present invention relates generally to the field of firearms, and more particularly to ammunition magazines for use with firearms.

BACKGROUND

Firearms, specifically rifles and handguns, often are used in conjunction with ammunition magazines. The magazines are loaded with ammunition, for example bullets, and then secured within a designated firearm. The magazines are then unsecured from the firearm when all of the ammunition from the magazine has been fired. The loading, securing, firing and removal process is typically performed countless times within the useful lifetime of a specific magazine.

In order to secure a magazine, the magazine typically secures to a magazine locating pin fixed within a firearm. The magazine locating pin is typically removably secured with a corresponding aperture located on a surface of the magazine. When the firearm is in use with the magazine, the magazine locating pin is secured with the aperture. When the firearm is not in use, the magazine is removed from the firearm by removing the magazine locating pin from the aperture.

Typically, the magazine and its locating pin are constructed of a rigid and durable material, for example metal. However, metal is heavy and subject to corrosion by moisture. Another example material is a composite polymer. The composite polymer is lightweight and resists corrosion, but is not as durable as metal. Through repeated use, the magazine aperture corresponding with the magazine locating pin can become worn and/or misshapen. This wearing down of the magazine aperture can, as a result, prevent a secure connection with the magazine locating pin and render the magazine inoperable.

Accordingly, it can be seen that needs exist for a magazine that can better withstand repeated securing to, and removal from, a magazine locating pin and therefore a firearm.

It is to the provision of a meeting these and other needs that the present invention is primarily directed.

SUMMARY

In example embodiments, the present invention provides a device for reinforcing a locating pin aperture in a firearm magazine.

In one aspect, the present invention relates to a reinforcement device for reinforcing a locating pin aperture in a firearm magazine. The example reinforcement device includes a front panel with an aperture adapted to be coaxially aligned with the locating pin aperture. The clamp is adapted to secure the front panel to the firearm magazine to ensure accurate alignment of the front panel aperture with the locating pin aperture.

In another aspect, the invention relates to an assembly for reinforcing a firearm magazine locating pin aperture. The example assembly includes a firearm magazine having a recessed region that surrounds the magazine locating pin aperture. The assembly also includes a clip adapted to secure to the recessed region. The clip includes an aperture adapted to coaxially align with the magazine locating pin aperture when the clip is secured to the recessed region.

In still another aspect, the invention relates to a device for reinforcing a locating pin aperture in a firearm magazine having a recessed receiver of a defined depth from the magazine surface. The device includes a clip adapted to secure to the firearm magazine within the recessed receiver. The clip has an aperture adapted to coaxially align with the locating pin aperture when the clip is secured to the recessed receiver.

In still another aspect the invention relates to an assembly for reinforcing a firearm magazine locating pin aperture. The assembly includes a molded synthetic firearm magazine with a recessed region that surrounds the magazine locating pin aperture. The recessed region includes a designated depth from the magazine surface and at least one raised body having a height substantially similar to the recessed region depth. The assembly also includes a clip having at least one aperture adapted to receive the at least one raised body when the clip is secured to the magazine recessed region. The clip includes an aperture adapted to coaxially align with the magazine locating pin aperture when the clip is secured to the recessed region. The clip has a thickness substantially similar to the recessed region depth.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms “a,” “an,” and “the” include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

The present invention generally relates to a reinforcement clip to be secured over a locating pin aperture in a firearm magazine for use with a firearm, for example a rifle or pistol. The reinforcement clip increases the durability of the locating pin aperture during repeated insertion and removal of a firearm magazine locating pin. This reinforcement clip can be a separate and removable element from a magazine or the reinforcement clip can be integrally and permanently secured to the magazine during the manufacture of the magazine, for example through a molding process. The example reinforcement clip can be designed to secure to a commonly-available magazine structure or the reinforcement clip can be designed to secure to a custom-designed magazine having a corresponding structure for securing the clip.

Figure 1:
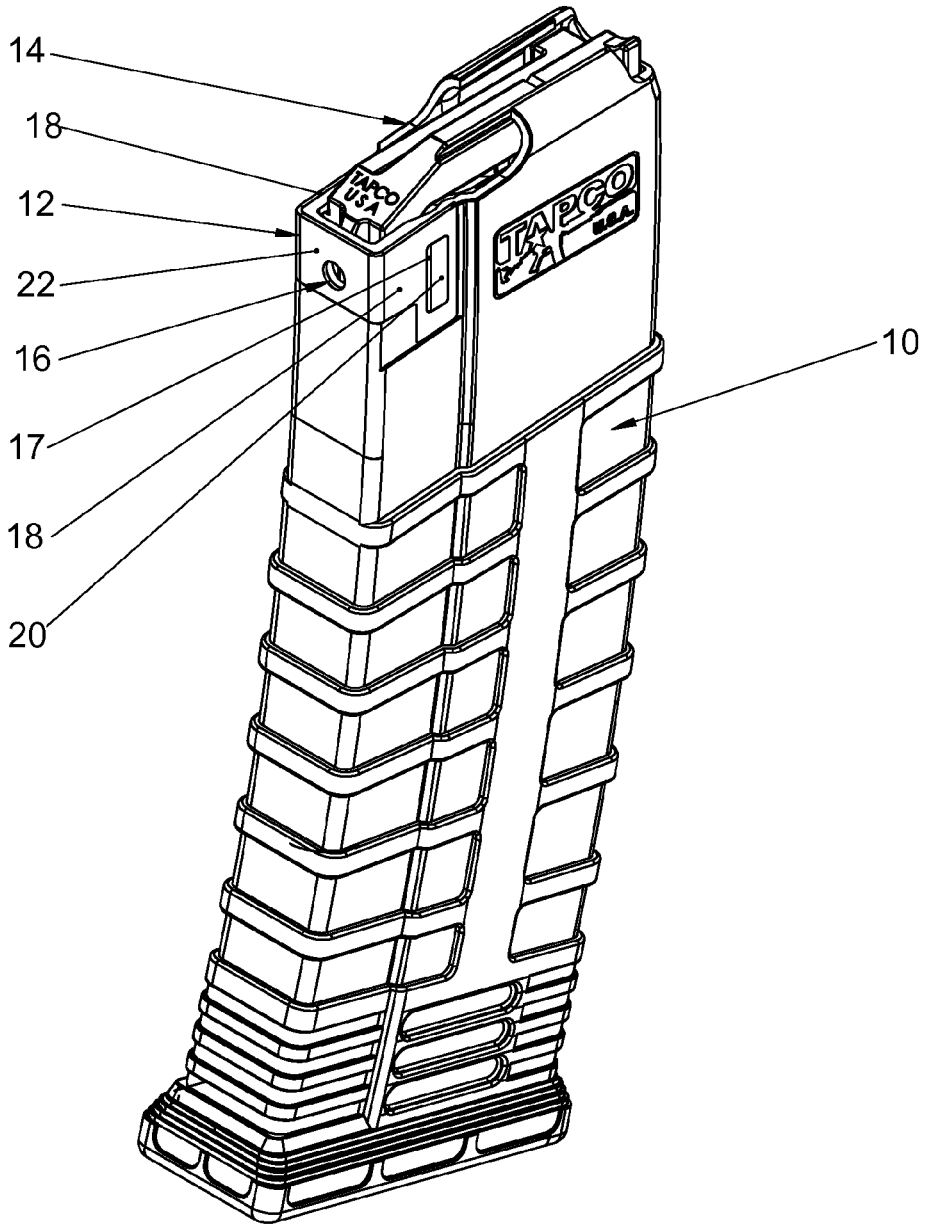
FIG. 1 is a perspective view of a reinforcement clip according to an example embodiment of the present invention, wherein the reinforcement clip is secured to a magazine.
Figure 2:
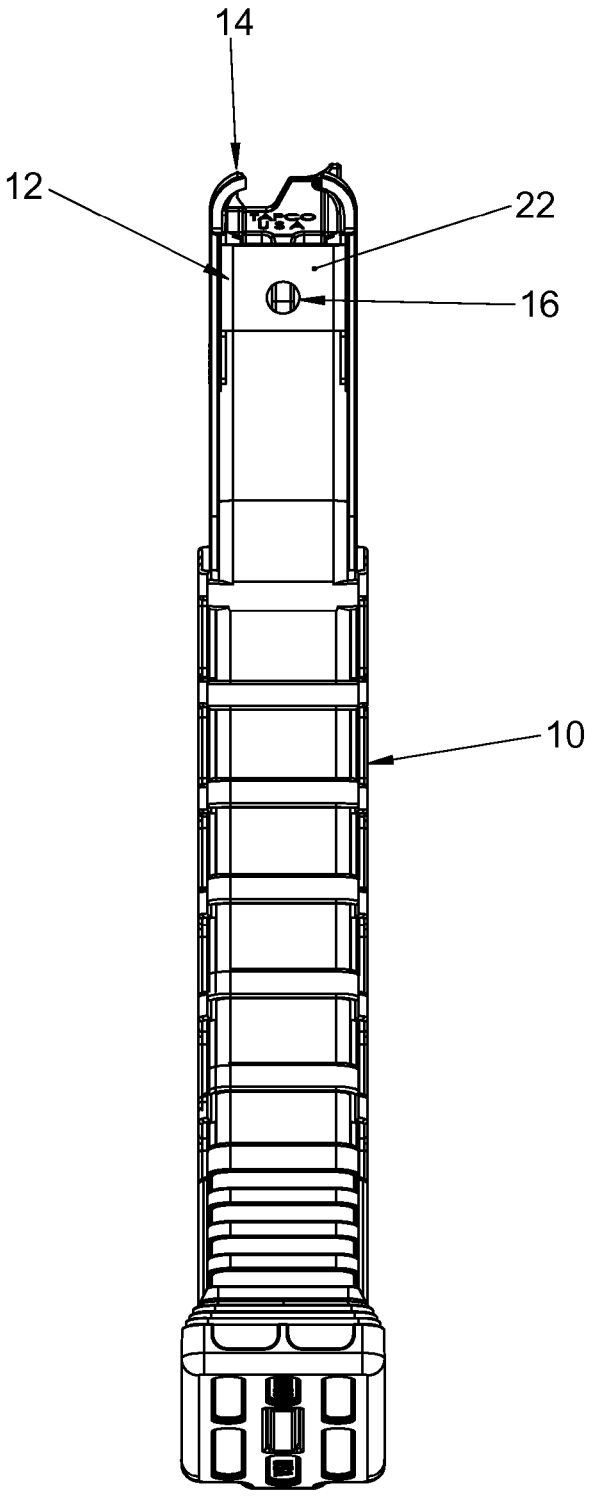
FIG. 2 is a front elevation view of the clip and magazine of FIG. 1.
Figure 3:
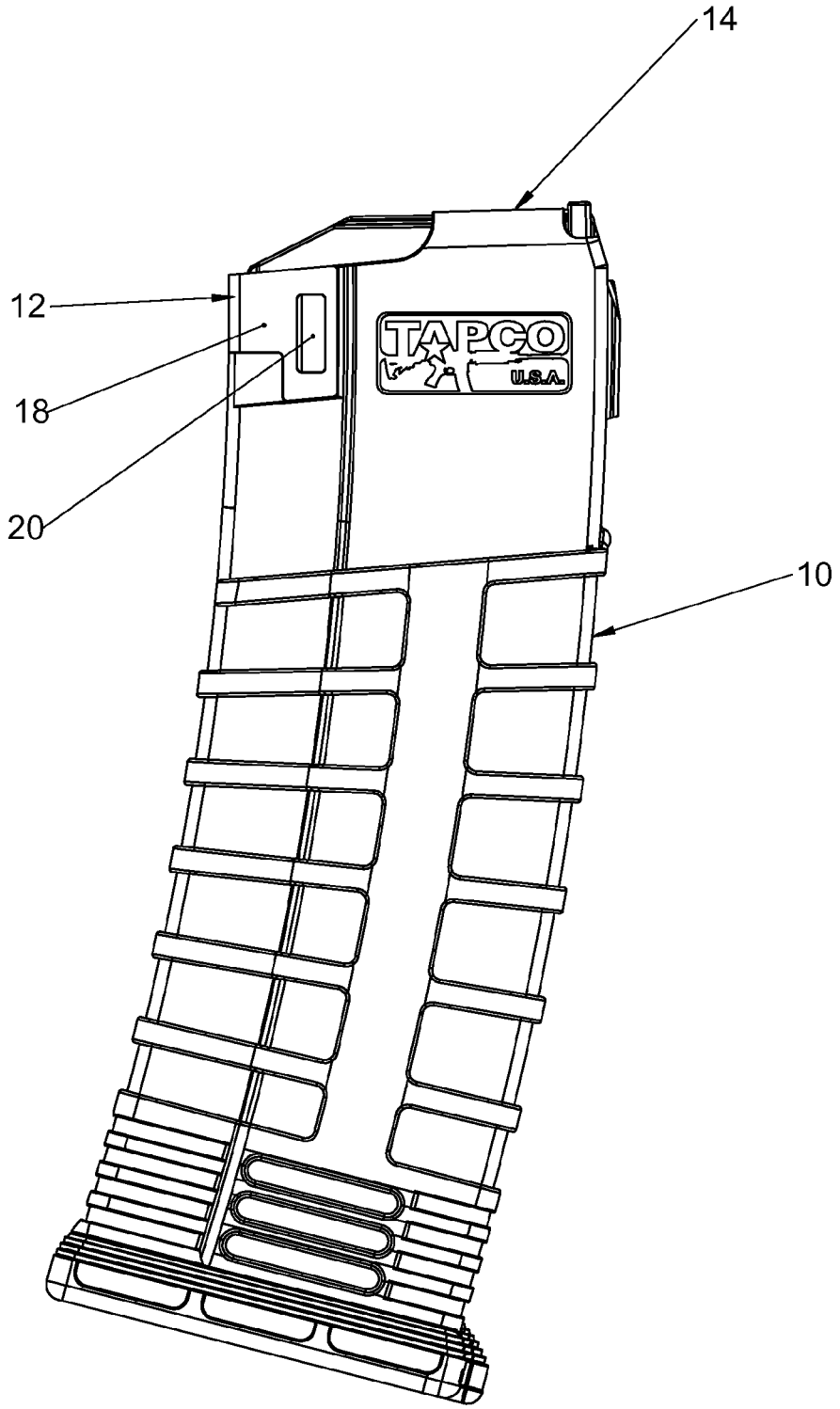
FIG. 3 is a side elevation view of the clip and magazine of FIG. 1.

With reference now to the drawing figures, wherein like reference numbers represent corresponding parts throughout the several views, FIGS. 1-3 show a firearm magazine 10 removed from connection with a firearm and for use with a reinforcement clip 12 according to an example embodiment of the invention. The depicted magazine 10 includes a top opening 14 into which ammunition is inserted by a user. The magazine 10 can be manufactured of a metal of a non-metal material. Preferably, the magazine 10 is manufactured of a non-metallic material, for example a composite polymer or a similar substance. The magazine 10 includes a locating pin aperture (shown in FIG. 4 as 32).

The reinforcement clip 12 is shown to be secured to a front face near the top opening 14 of the magazine 10. The reinforcement clip 12 is manufactured of a durable material, for example metal or other advanced materials. The depicted reinforcement clip 12 includes a front panel 22 and a clamp. As depicted, the front panel 22 includes an aperture 16 that aligns with the locating pin aperture (further shown in FIG. 4 as 32) when installed on the magazine 10, and that aligns with and receives a magazine locating pin (not shown) when the magazine 10 is secured to the firearm for active use. For example, the aperture 16 can be centrally-located on the front panel 22. Preferably, this aperture 16 has a size and shape to correspondingly receive a typical magazine locating pin. The depicted aperture 16 has a circular shape to correspond with the circular shape of a typical magazine locating pin aperture 32 located on a typical magazine.

The clamp can be any structure that prevents the reinforcement clip 12 from being removed from the magazine 10 during the course of its typical lifetime of use without intervening user action. For example, the clamp can include teeth or a lip. In a typical commercial embodiment, as depicted, the clamp includes two symmetrical side walls 18, each extending from the vertical edges of the front panel 22. Each side wall 18 includes a grip that secures to a receiver on the magazine 10. As depicted, an example grip is an aperture 17 and an example receiver is a raised body 20. An example raised body can have a shape resembling a plateau having vertically-angled side walls and a substantially flat top surface. The aperture 17 fits over the raised body 20 for effective use. Preferably, the size and shape of the raised body 20 correspond to fit snugly within the aperture 17. As depicted, the aperture 17 and corresponding raised body 20 are both rectangular, however, alternative shapes such as circular, polygonal or other regular or irregular shapes are considered effective. Additionally, each wall 18 can further include additional apertures (not shown) to grip to additional raised bodies (not shown).

The side walls 18 can be resiliently flexible with respect to the front face 22 to deflect laterally outwardly in order to place the apertures 24 over the raised bodies 20. Such flexing requires an application of outwardly-directed force onto an interior surface of each wall 18. Upon application of the apertures 24 over the raised bodies 20, the walls 18 automatically return inwardly toward each other to apply pressure against the magazine 10.

Preferably, the clip 12 has a consistent thickness throughout the front face and the side walls. However, the thickness can alternatively vary, as designed, between the front face and the side walls. Preferably, the clip 12 has a unitary construction. Alternatively, the clip 12 can be constructed of separable parts that can be assembled together for use.

When the apertures 17 are secured around the raised bodies 20, the reinforcement clip 12 will not slip off of the magazine 10 during normal use. The reinforcement clip 12 can be permanently secured to the magazine 10 or temporarily and removably secured. For example, adhesive material can be applied to either the clip 12 or magazine 10 to permanently secure the clip to the magazine. Alternatively, the clip 12 can be removably secured to the magazine 10 with a friction fit and resistance by simply securing the grip apertures 17 over and around the corresponding raised bodies 20.

Figure 4:
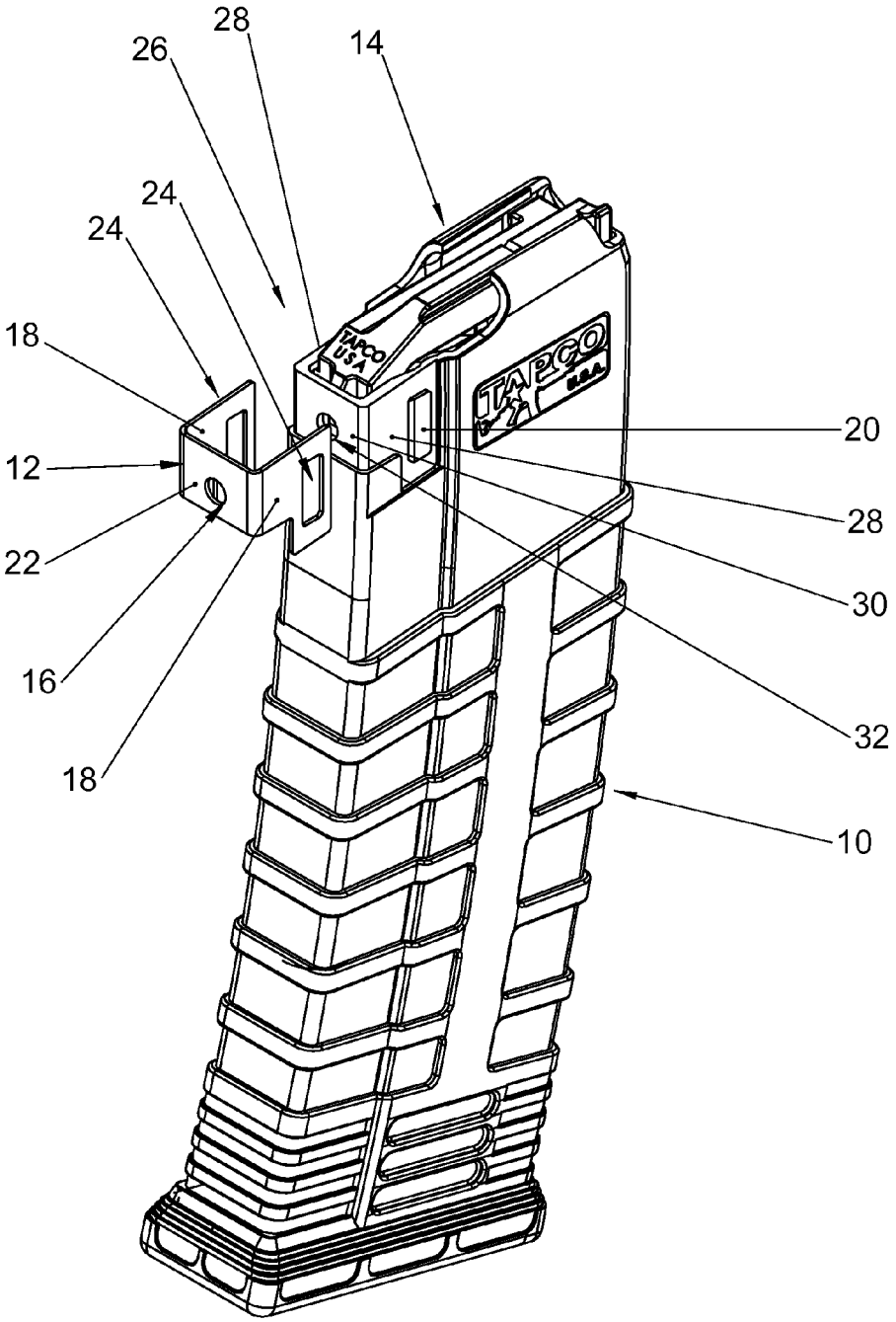
FIG. 4 is a perspective exploded view of the clip and magazine of FIG. 1 showing the reinforcement clip removed from the magazine.
Figure 5:
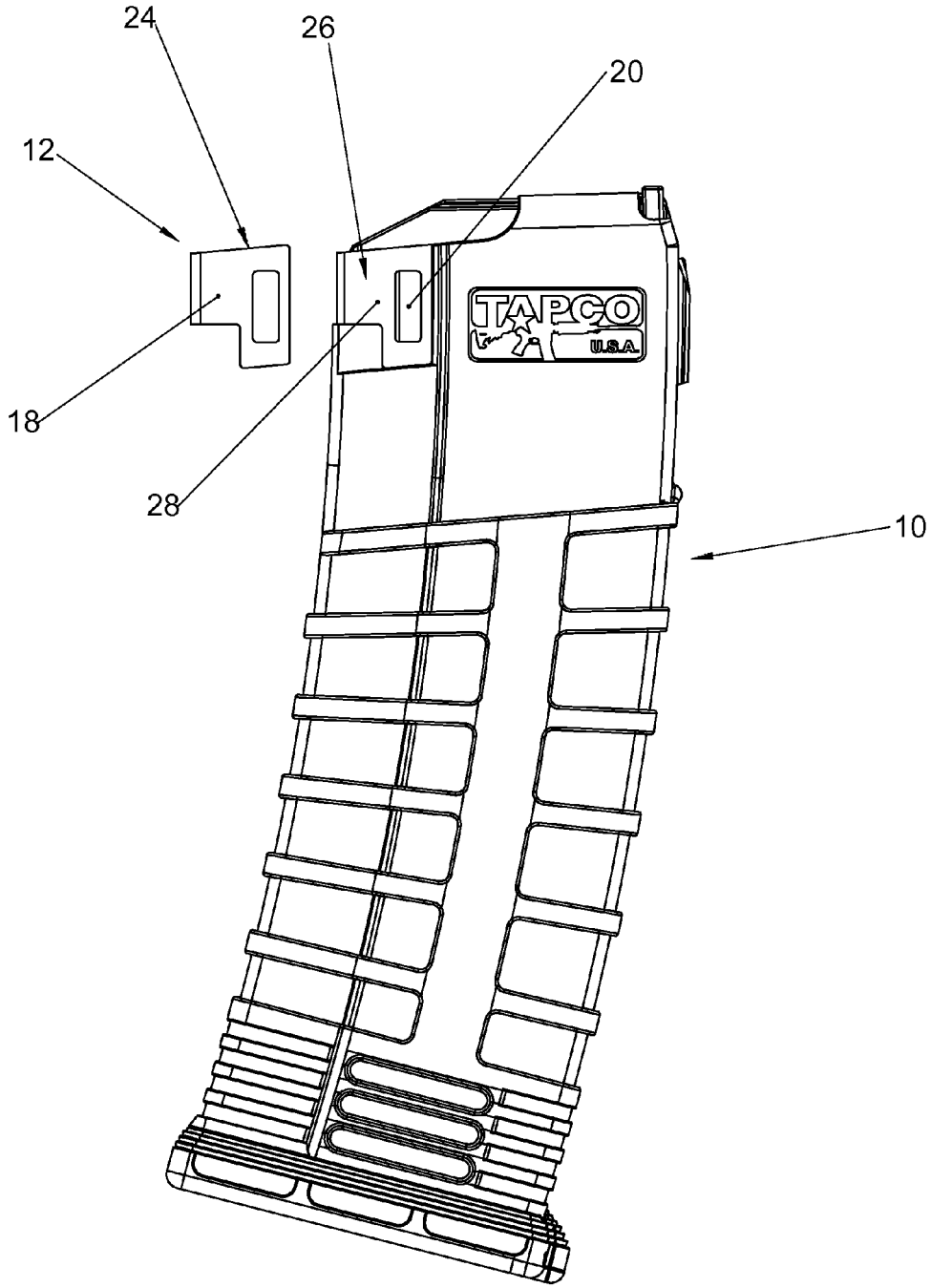
FIG. 5 is a side elevation view of the clip and magazine of FIG. 4.
Figure 6:
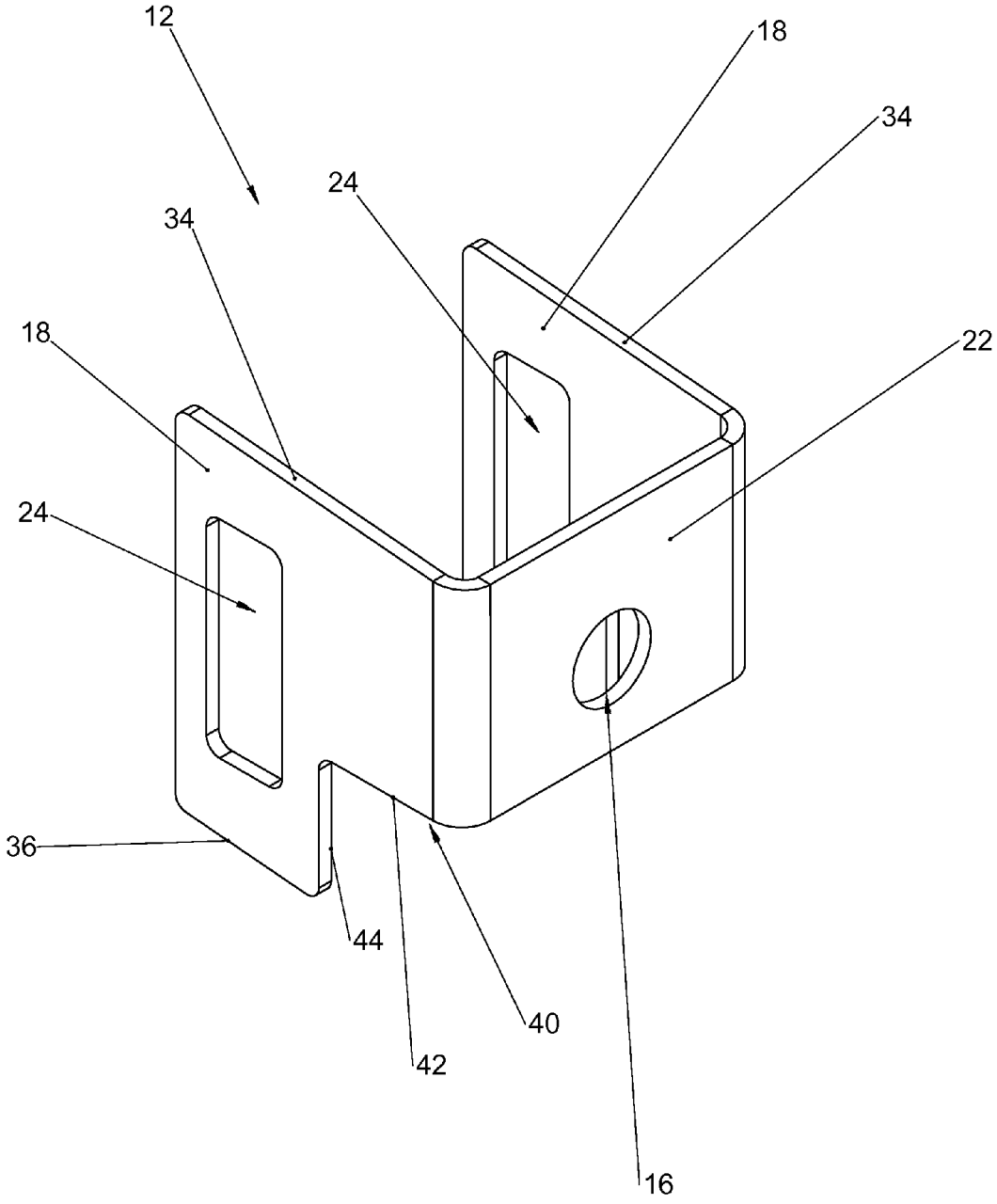
FIG. 6 is an isolated perspective view of the reinforcement clip as shown in FIG. 1.

In FIGS. 4 and 5, the reinforcement clip 12 is shown removed from the magazine 10. The magazine 10 is shown to include a recessed region 26 that receives the clip 12 when the magazine is in use engaged with a firearm. As depicted, the recessed region 26 is cut out from or molded integrally into the magazine 10 surface. The example recessed region 26 includes a front face 30 and two side walls 28 extending from the front face. Preferably the size and shape of the recessed region 26 corresponds to the matching surface of the clip 12. The depth of the recessed region 26 from the surface of the magazine 10 and the height of the raised body 20 are about equal to the thickness of the clip 12 so that when the clip is secured within the recessed region there is a consistent outer surface of the magazine.

Figure 7:
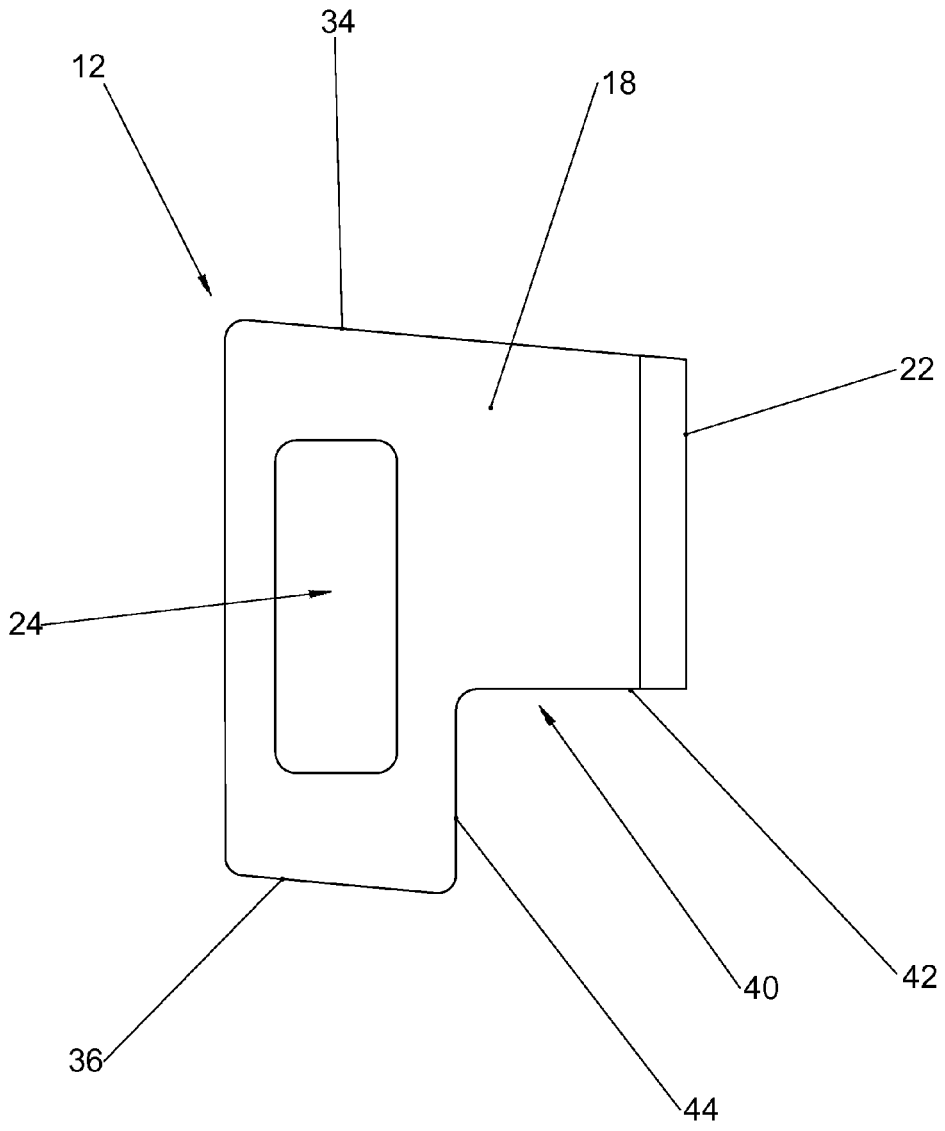
FIG. 7 is a side view of the clip shown in FIG. 6.
Figure 8:
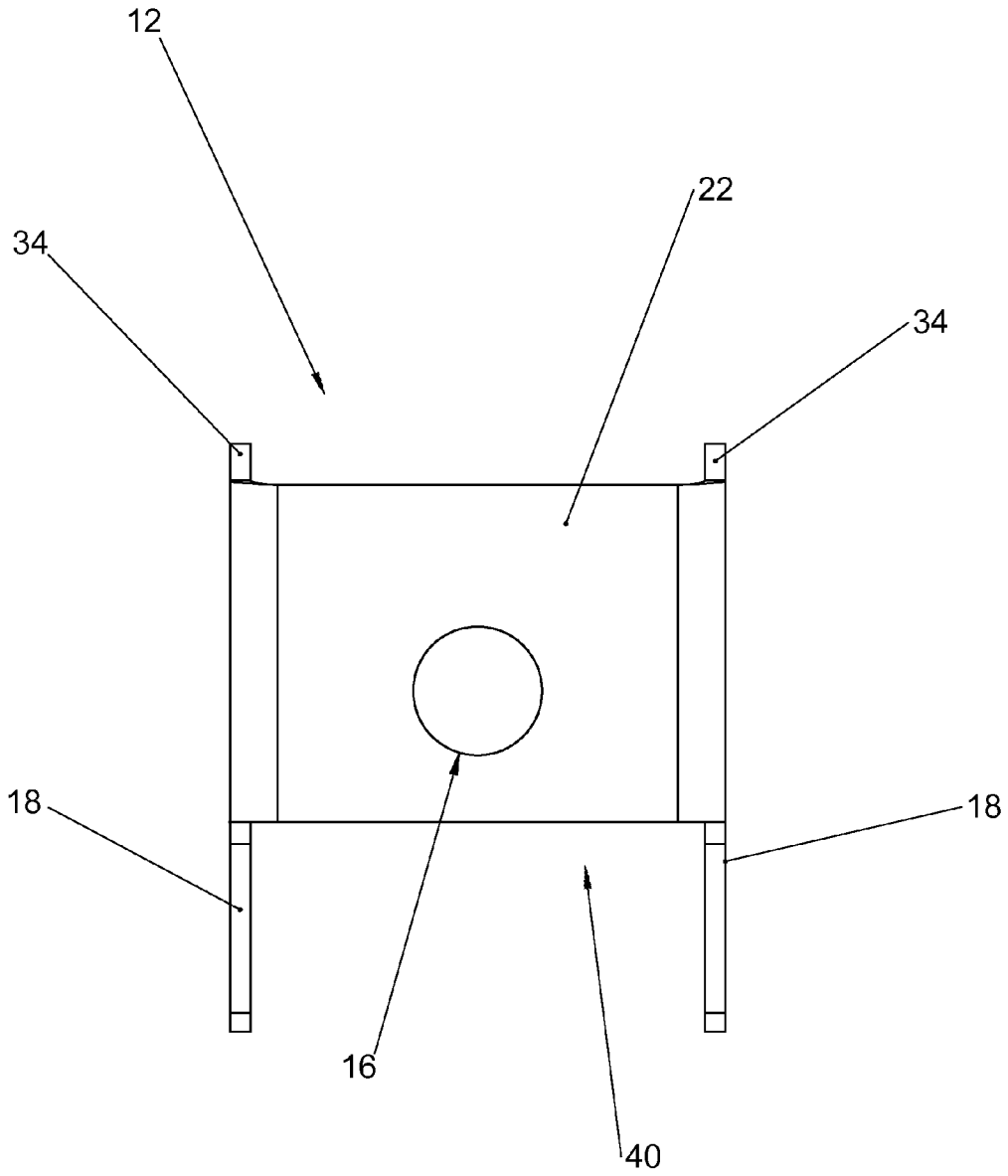
FIG. 8 is a front view of the clip shown in FIG. 6.
Figure 9:
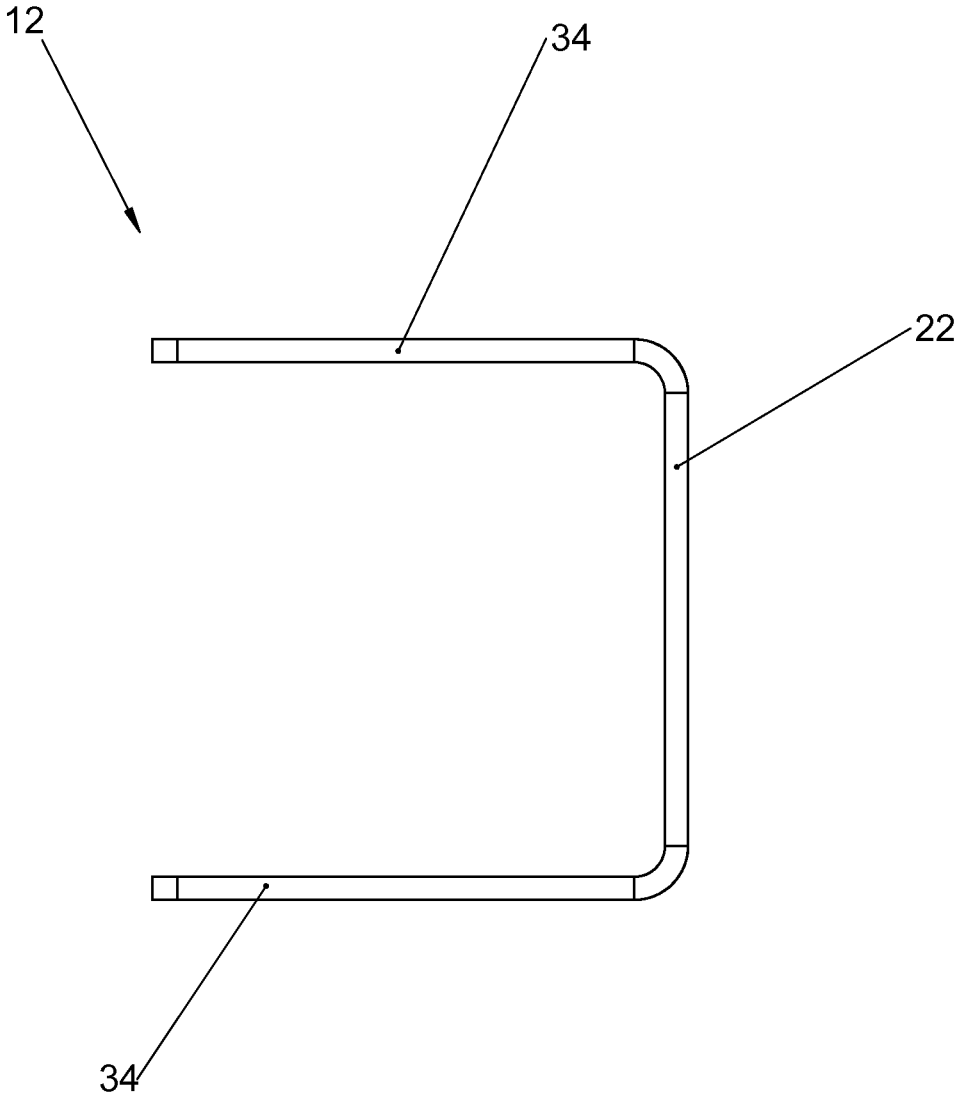
FIG. 9 is a top view of the clip shown in FIG. 6.

FIGS. 6-9 show the clip 12 isolated and removed from the magazine (not shown). As depicted, the clip 12 includes a top edge 34 that extends throughout the side walls 18 and the front face 22. As shown in FIG. 7, the side wall sections of the top edge 34 can horizontally extend at a downward angle with respect to horizontal toward the front face 22 of the clip. The side walls 18 include a lower edge 36 that extends until contact with the vertical edge 44 of an inverted L-shaped region 40 including a horizontal edge 42 and the vertical edge. As shown in FIG. 7, the lower edge 36 can horizontally extend at a parallel angle with the top edge 34. As depicted in FIGS. 8 and 9 the side walls 18 can be vertically parallel with respect to each other. Alternatively, the side walls can be slightly angled toward each other (not shown) as they extend from the front face 22.

In alternate embodiments, the sidewalls of the clip extend along the entire length of the magazine sides and are connected by a back wall so that the clip is annular and extends around the entire periphery of the magazine. In other alternate embodiments, the grip and raised body are reversed, that is, the grip of the clip is a raised body that corresponds with an aperture in the magazine. In yet a further alternate embodiment, the side walls of the clip extend downwardly beyond the top horizontal side ribs, which form the raised bodies, and have grip apertures configured to receive the receiver ribs.

While the invention has been described with reference to preferred and example embodiments, it will be understood by those skilled in the art that a variety of modifications, additions and deletions are within the scope of the invention, as defined by the following claims.

What is claimed is:

1. An assembly for reinforcing a firearm magazine locating pin aperture, the assembly comprising:

a firearm magazine comprising a recessed region that surrounds the magazine locating pin aperture, the recessed region being formed in an exterior surface of the firearm magazine; and a clip adapted to secure to the recessed region on the exterior surface of the firearm magazine, wherein the clip comprises an aperture adapted to coaxially align with the magazine locating pin aperture when the clip is secured to the recessed region;

wherein the magazine locating in aperture and the aperture are configured to receive a magazine locating in to secure the firearm magazine within a firearm.

2. The assembly of claim 1, wherein the magazine is comprised of a molded synthetic material.

3. The assembly of claim 2, wherein the clip is integrally molded to the magazine.

4. The assembly of claim 2, wherein the recessed region comprises a designated depth in the exterior surface of the firearm magazine.

5. The assembly of claim 4, wherein the clip comprises a thickness substantially similar to the recessed region depth.

6. The assembly of claim 5, wherein the magazine recessed region further comprises at least one raised body formed on the exterior surface of the firearm magazine and having a height substantially similar to the recessed region depth.

7. The assembly of claim 6, wherein the clip comprises at least one grip aperture adapted to receive the at least one raised body when the clip is secured to the magazine.

8. An assembly for reinforcing a firearm magazine locating pin aperture, the assembly comprising:

a molded synthetic firearm magazine comprising a recessed region that surrounds the magazine locating pin aperture, wherein the recessed region comprises a designated depth in an exterior surface of the firearm magazine and at least one raised body having a height substantially similar to the recessed region depth; and a clip comprising at least one aperture adapted to receive the at least one raised body when the clip is secured to the magazine recessed region on the exterior surface of the firearm magazine, wherein the clip comprises an aperture adapted to coaxially align with the magazine locating pin aperture when the clip is secured to the recessed region, and wherein the clip comprises a thickness substantially similar to the recessed region depth.

9. The assembly of claim 8, wherein the clip is integrally molded to the magazine recessed region.

* * * * *

UNITED STATES PATENT AND TRADEMARK OFFICE

CERTIFICATE OF CORRECTION

PATENT NO. : 8,713,834 B2
APPLICATION NO. : 13/048524
DATED : May 6, 2014
INVENTOR(S) : Buddie Daniel et al.

It is certified that error appears in the above-identified patent and that said Letters Patent is hereby corrected as shown below:

In the Claims

Claim 1, column 5, lines 20 and 21 - "magazine locating in" should read "magazine locating pin" in both instances.

Signed and Sealed this
Twenty-third Day of September, 2014

Michelle K. Lee

Michelle K. Lee
*Deputy Director of the United States Patent and Trademark Office*